US007284846B2

(12) United States Patent
Katayama

(10) Patent No.: US 7,284,846 B2
(45) Date of Patent: Oct. 23, 2007

(54) INK INJECTION SYSTEM AND INK CARTRIDGE FOR USE IN THE SAME

(75) Inventor: Naoki Katayama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 348 days.

(21) Appl. No.: 10/951,585

(22) Filed: Sep. 29, 2004

(65) Prior Publication Data

US 2005/0068351 A1 Mar. 31, 2005

(30) Foreign Application Priority Data

Sep. 30, 2003 (JP) ..... 2003-341996

(51) Int. Cl.
*B41J 2/175* (2006.01)

(52) U.S. Cl. ..... 347/86

(58) Field of Classification Search ..... 347/7, 347/85–87

See application file for complete search history.

(56) References Cited

U.S. PATENT DOCUMENTS 5,920,333 A 7/1999 Bates
6,196,670 B1 * 3/2001 Saruta ..... 347/86
6,209,980 B1 * 4/2001 Kobayashi et al. ..... 347/7
6,471,333 B1 10/2002 Powell et al.
6,736,496 B2 * 5/2004 Hanaoka et al. ..... 347/86

FOREIGN PATENT DOCUMENTS

DE 34 05 164 A1 8/1985
EP 1 284 192 A2 2/2003
JP A 2003-25608 1/2003
JP A 2003-145792 5/2003

* cited by examiner

*Primary Examiner*—An H. Do
(74) *Attorney, Agent, or Firm*—Oliff & Berridge, PLC

(57) ABSTRACT

An ink-cartridge ink injection system has: an ink cartridge to be injected with predetermined ink which is one of a plurality of kinds of inks, the ink cartridge including a display portion for displaying the kind of the predetermined ink to be injected, and a to-be-detected portion to be detected for identifying the predetermined ink to be injected, the to-be-detected portion being provided in a position corresponding to the predetermined ink displayed by the display portion, the position being one of a plurality of different positions corresponding to the plurality of kinds of inks; and an ink injector for injecting the predetermined ink into the ink cartridge, the ink injector including an ink identifying unit for detecting the to-be-detected portion to thereby identify the kind of ink to be injected into the ink cartridge before injecting ink into the ink cartridge.

17 Claims, 9 Drawing Sheets

INK INJECTION SYSTEM AND INK CARTRIDGE FOR USE IN THE SAME

BACKGROUND OF THE INVENTION

1. Field of the Invention

The present invention relates to an ink injection system for injecting predetermined ink into an ink cartridge by means of an ink injector, and an ink cartridge for use in the ink injection system.

2. Description of the Related Art

Inkjet printers generally use a plurality of kinds of color inks to perform high-quality color printing. Accordingly, a plurality of ink cartridges injected with a plurality of kinds of color inks respectively can be mounted on such a printer. Here, ink cartridges having one and the same shape are often used for the plurality of kinds of color inks.

Some ink cartridges have identification blocks as built-in parts (e.g. see JP-A-2003-145792). In each identification block, a notch groove is formed in conformity with an identification piece provided in a predetermined position on a recording apparatus side. The position of the groove bottom of the notch groove (notch groove length) and the front end position of the identification piece (identification piece length) corresponding to that position are set to correspond to the kind of ink. Thus, the ink cartridge is prevented from being erroneously attached to a recording apparatus.

SUMMARY OF THE INVENTION

When the ink cartridge is made from a transparent member, the kind of ink can be confirmed easily from the outside of the ink cartridge. On the other hand, when the ink cartridge is made from an opaque member for maintaining the quality of ink, it is difficult to confirm the kind of ink from the outside of the ink cartridge. In this event, even when the ink cartridge has an identification block as described above, it is difficult to confirm the kind of ink from the outside of the ink cartridge because a notch groove is simply formed in the identification block. Accordingly, for example, when ink cartridges are classified in accordance with kinds of inks individually, the work of the classification is extremely troublesome for workers.

It is conceived that such a problem also appears likewise in a work after the work of injecting inks into ink cartridges. During manufacturing of ink cartridges, a plurality of kinds of color inks are injected into the ink cartridges respectively by ink dispensers (ink injectors) corresponding to the plurality of kinds of color inks respectively. When an ink cartridge is made of an opaque material, a label for identifying the kind of ink is often pasted to the ink cartridge by a worker in order to make it possible to confirm the kind of ink easily from the outside of the ink cartridge. However, when the worker pastes the label, it is likely that the worker will erroneously paste a label corresponding to a different kind of ink from the kind of ink injected into the ink cartridge.

It is therefore an object of the invention to provide an ink injection system and an ink cartridge in which erroneous ink injection in an ink injector can be prevented, and the kind of ink injected into the ink cartridge can be confirmed easily.

According to an aspect of the invention, there is provided an ink-cartridge ink injection system including: an ink cartridge to be injected with predetermined ink which is one of a plurality of kinds of inks, the ink cartridge including a display portion for displaying the kind of the predetermined ink to be injected, and a to-be-detected portion to be detected for identifying the predetermined ink to be injected, the to-be-detected portion being provided in a position corresponding to the predetermined ink displayed by the display portion, the position being one of a plurality of different positions corresponding to the plurality of kinds of inks; and an ink injector for injecting the predetermined ink into the ink cartridge, the ink injector including an ink identifying unit for detecting the to-be-detected portion to thereby identify the kind of ink to be injected into the ink cartridge before injecting ink into the ink cartridge.

According to this configuration, a worker (operator) operating the ink injector can easily confirm the kind of ink to be injected into the ink cartridge through the display portion before injecting ink into the ink cartridge by means of the ink injector. In addition, in the ink injector, the to-be-detected portion provided in accordance with the kind of ink in the ink cartridge is detected by the ink identifying unit so as to identify the kind of ink to be injected. As a result, in the ink injector, a different kind of ink from the kind displayed in the display portion of the ink cartridge can be prevented from being erroneously injected into the ink cartridge. Further, also after ink injection, the kind of ink injected into the ink cartridge can be confirmed easily on the display portion.

Here, for example, the "display portion for displaying the kind of ink" includes characters, symbols, identification marks, etc., for indicating the kind of ink so that the kind of ink can be confirmed easily. For example, the display portion indicating black ink may include at least one of a Chinese character meaning black, Japanese characters meaning black, a symbol such as "K", and an identification mark such as a region with black color.

According to another aspect of the invention, there is provided an ink-cartridge ink injection system including: an ink cartridge to be injected with predetermined ink which is one of a plurality of kinds of inks, the ink cartridge including a display portion for displaying the kind of the predetermined ink to be injected, and a to-be-fitted portion provided in a position corresponding to the predetermined ink displayed by the display portion, the position being one of a plurality of different positions corresponding to the plurality of kinds of inks; and an ink injector for injecting the predetermined ink into the ink cartridge, the ink injector including a mounting portion to be mounted with the ink cartridge, and an injecting unit for injecting the predetermined ink into the ink cartridge mounted on the mounting portion, the mounting portion including a fitting portion capable of fitting only to the to-be-fitted portion of the ink cartridge to be injected with the predetermined ink.

According to this configuration, a worker (operator) of the ink injector can easily confirm the kind of ink to be injected into the ink cartridge through the display portion before injecting ink into the ink cartridge by means of the ink injector. In addition, the mounting portion of the ink injector is provided with a fitting portion capable of fitting only to the to-be-fitted portion provided in accordance with the kind of ink in the ink cartridge. As a result, in the ink injector, a different kind of ink from the kind displayed in the display portion of the ink cartridge can be prevented from being erroneously injected into the ink cartridge. Further, also after ink injection, the kind of ink injected into the ink cartridge can be confirmed easily on the display portion.

According to still another aspect of the invention, there is provided an ink cartridge including: a cartridge body to be injected with predetermined ink by an ink injector, the predetermined ink being one of a plurality of kinds of inks;

a display portion for displaying the kind of the predetermined ink to be injected; and a to-be-detected portion to be detected when the predetermined ink to be injected is identified in the ink injector to be mounted with the cartridge body, the to-be-detected portion being provided in a position corresponding to the predetermined ink displayed by the display portion, the position being one of a plurality of different positions corresponding to the plurality of kinds of inks.

According to this configuration, a worker of the ink injector can easily confirm the kind of ink to be injected into the ink cartridge through the display portion before attaching the ink cartridge to the ink injector. In addition, in the ink injector, the to-be-detected portion provided in accordance with the kind of ink in the ink cartridge can be detected to identify the kind of ink to be injected into the ink cartridge. As a result, in the ink injector, a different kind of ink from the kind displayed in the display portion of the ink cartridge can be prevented from being erroneously injected into the ink cartridge. Further, also after ink injection, the kind of ink injected into the ink cartridge can be confirmed easily on the display portion.

According to still another aspect of the invention, there is provided an ink cartridge including: a cartridge body to be injected with predetermined ink by an ink injector, the predetermined ink being one of a plurality of kinds of inks; a display portion for displaying the kind of the predetermined ink to be injected; and a to-be-fitted portion provided in a position corresponding to the predetermined ink displayed by the display portion, the position being one of a plurality of different positions corresponding to the plurality of kinds of inks; wherein the cartridge body is allowed to be injected with ink by the ink injector when the to-be-fitted portion is fitted to a fitting portion of the ink injector corresponding to the kind of the predetermined ink.

According to this configuration, a worker of the ink injector can easily confirm the kind of ink to be injected into the ink cartridge through the display portion before attaching the ink cartridge to the ink injector. In addition, when the ink cartridge is mounted in the mounting portion of the ink injector, ink is allowed to be injected by the ink injector only if the to-be-fitted portion provided in accordance with the kind of ink in the ink cartridge is fitted to the fitting portion of the ink injector corresponding to the kind of ink. As a result, in the ink injector, a different kind of ink from the kind displayed in the display portion of the ink cartridge can be prevented from being erroneously injected into the ink cartridge.

BRIEF DESCRIPTION OF THE DRAWINGS

The present invention may be more readily described with reference to the accompanying drawings.

DETAILED DESCRIPTION OF THE PREFERRED EMBODIMENTS

Figure 1:
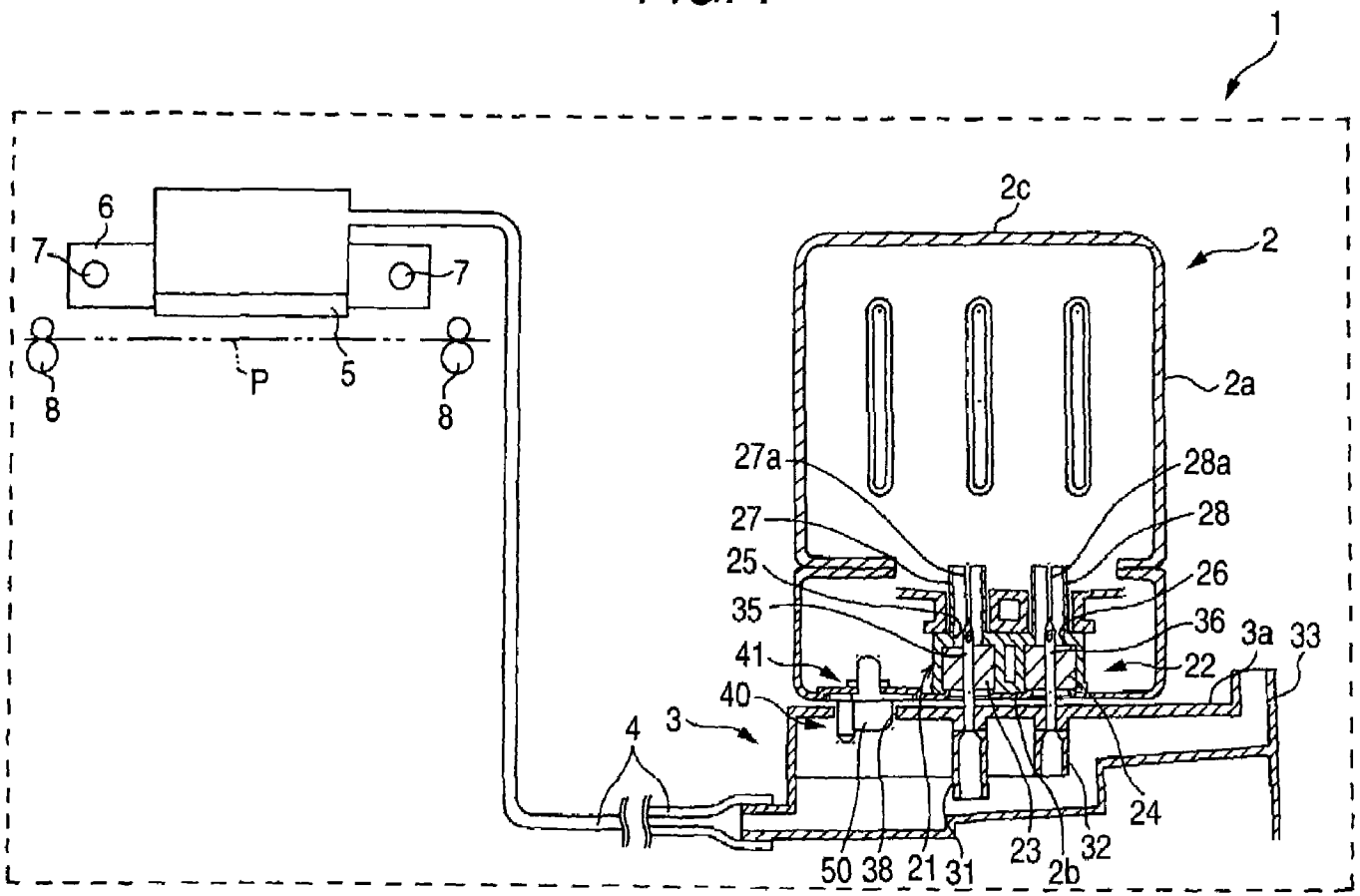
FIG. 1 is a diagram showing the schematic configuration of an inkjet printer mounted with an ink cartridge according to an embodiment of the invention.

A preferred embodiment of the invention will be described below with reference to the drawings. FIG. 1 is a diagram showing the schematic configuration of an inkjet printer mounted with ink cartridges according to the embodiment of the invention. Incidentally, FIG. 1 shows only an ink cartridge 2 injected with black ink, and a buffer tank 3 mounted with the ink cartridge 2.

An inkjet printer 1 has a plurality of ink cartridges 2, buffer tanks 3, inkjet heads 5 (hereinafter referred to as "heads 5" simply), a carriage 6, carriage shafts 7 and conveyance mechanisms 8. The ink cartridges 2 are filled with color inks of four colors, cyan, magenta, yellow and black, respectively. Each ink cartridge 2 is removably attached to the corresponding buffer tank 3. The buffer tank 3 reserves ink supplied from the ink cartridge 2 through an ink introduction pipe 35. Ink supplied from the buffer tank 3 to the corresponding head 5 through a supply tube 4 is ejected onto paper P by the head 5. The carriage 6 mounted with the heads 5 reciprocates in a straight line direction. The carriage shafts 7 serve as guides when the carriage 6 reciprocates. The conveyance mechanisms 8 convey the paper P.

The ink cartridge 2 has an ink vessel 2*a* for receiving ink. The ink vessel 2*a* has an ink injection surface 2*b* (a lower wall surface in FIG. 1, the wall surface being the bottom when the ink cartridge 2 is attached to the buffer tank 3). The ink injection surface 2*b* is provided with two insertion portions 21 and 22 for receiving the ink introduction pipe 35 and an outside-air introduction pipe 36. Stoppers 23 and 24 for sealing the inside of the ink cartridge 2 hermetically are fitted into the insertion portions 21 and 22 respectively in the condition that the stoppers 23 and 24 have been compressed. Here, the stoppers 23 and 24 touch the ink in the ink vessel 2*a* through inlets 25 and 26 opened in the ink injection surface 2*b* of the ink vessel 2*a* respectively.

An ink passageway portion 27 shaped like a comparatively short cylinder is provided on the ink injection surface 2*b* of the ink vessel 2*a*. The ink passageway portion 27 is disposed to surround the inlet 25 and project toward a closed surface 2*c* (an upper wall surface in FIG. 1) opposed to the ink injection surface 2*b*. A front end portion of the ink passageway portion 27 is made open to allow the space in the ink vessel 2*a* and the space in the ink passageway portion 27 to communicate with each other. In addition, two slits 27*a* are formed in side walls (a side wall on the near side of the paper of FIG. 1 and a side wall on the deeper side of the paper of FIG. 1) of the ink passageway portion 27. Each of the two slits 27*a* is an opening having a rectangular gap and disposed diagonally in the ink passageway portion 27. The slits 27*a* serve to make substantially full use of the ink in the ink vessel 2*a*.

In addition, an outside-air passageway portion 28 shaped like a comparatively short cylinder is provided on the ink injection surface 2*b* of the ink vessel 2*a*. The outside-air passageway portion 28 is disposed to surround the inlet 26 and project toward the closed surface 2*c* opposed to the ink injection surface 2*b*. A front end portion of the outside-air passageway portion 28 is made open to allow the space in the ink vessel 2*a* and the space in the outside-air passageway portion 28 to communicate with each other. In addition, two slits 28*a* are formed in side walls (a side wall on the near side of the paper of FIG. 1 and a side wall on the deeper side of the paper of FIG. 1) of the outside-air passageway portion 28. Each of the two slits 28*a* is an opening having a rectangular gap and disposed diagonally in the outside-air passageway portion 28. The slits 28*a* serve to prevent ink from remaining in the outside-air passageway portion 28 and make substantially full use of the ink in the ink vessel 2*a*.

The ink introduction pipe 35 shaped like a hollow needle and the outside-air introduction pipe 36 shaped like a hollow needle are provided in the buffer tank 3. The ink introduction pipe 35 serves to lead out the ink reserved in the ink cartridge 2 and supply the ink to the head 5. The outside-air introduction pipe 36 serves to introduce the outside air into the ink cartridge 2 as the ink is led out from the ink introduction pipe 35. The ink introduction pipe 35 and the outside-air introduction pipe 36 are disposed to penetrate a ceiling wall 3*a* and project thereon substantially in parallel. In the buffer tank 3, a cylindrical ink passageway portion 31 is provided to be connected to a lower end portion of the ink introduction pipe 35, while a cylindrical outside-air passageway portion 32 is provided to be connected to be connected to a lower end portion of the outside-air introduction pipe 36. Here, the ink passageway portion 31 and the outside-air passageway portion 32 project from the ceiling wall 3*a* of the buffer tank 3 into the buffer tank 3, and the lower end portions of the ink introduction pipe 35 and the outside-air introduction pipe 36 are disposed in the base portions of the ink passageway portion 31 and the outside-air passageway portion 32 respectively. Incidentally, the lower end open portion of the outside-air passageway portion 32 is disposed in a position higher than the lower end open portion of the ink passageway portion 31.

When the ink cartridge 2 is attached to the buffer tank 3, the front ends of the ink introduction pipe 35 and the outside-air introduction pipe 36 pierce the stoppers 23 and 24 respectively, and enter the inside of the ink cartridge 2. Then, the front ends of the ink introduction pipe 35 and the outside-air introduction pipe 36 touch the ink in the ink cartridge 2. Incidentally, the stoppers 23 and 24 are formed out of an elastic material such as butyl rubber, so that the ink introduction pipe 35 and the outside-air introduction pipe 36 can pierce the stoppers 23 and 24. Since the stoppers 23 and 24 are fitted into the insertion portions 21 and 22 in the condition that the stoppers 23 and 24 have been compressed, the stopper 23 and 24 are recovered to seal the inside of the ink vessel 2*a* hermetically due to an elastic effect even after the ink introduction pipe 35 and the outside-air introduction pipe 36 are pulled out.

Further, an outside-air connection path 33 whose upper end is opened is provided in an upper portion of the buffer tank 3. Accordingly, the upper space in the buffer tank 3 communicates with the outside air through the outside-air connection path 33.

Figure 2A:
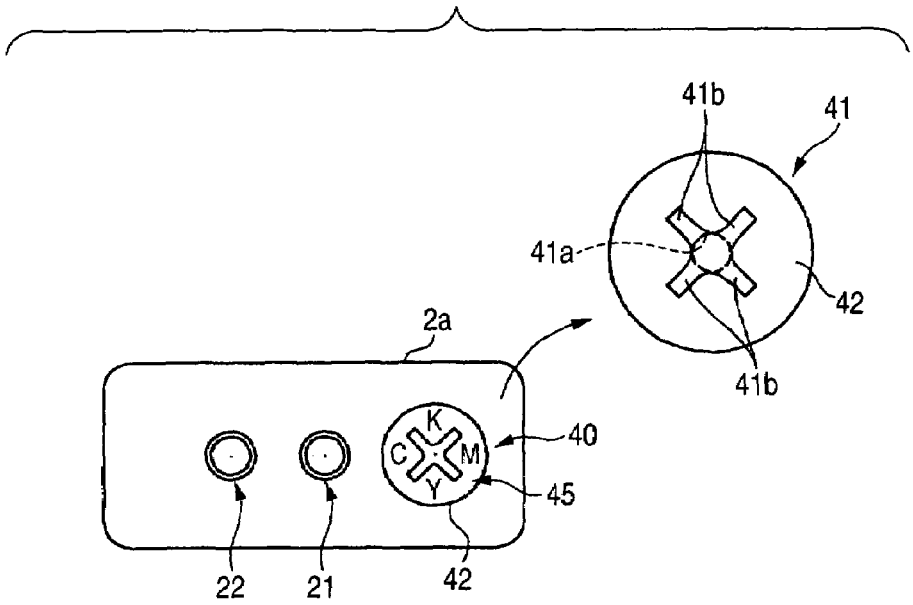
FIG. 2A is a top view of the ink cartridge shown in FIG. 1.
Figure 2B:
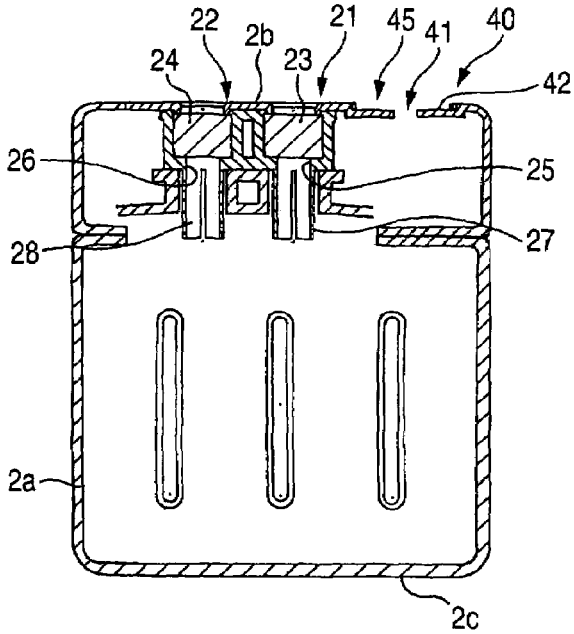
FIG. 2B is a cross-sectional view of the ink cartridge shown in FIG. 1.

Near the ink injection surface 2*b* of the ink vessel 2*a*, a mounting portion 41 to be mounted with an ink identification member 50 included in a display portion 40 is provided in a portion near an extension of the two insertion portions 21 and 22 and close to the insertion portion 21 (see FIGS. 2A and 2B). In the ceiling wall 3*a* of the buffer tank 3, a fitting hole 38 (a fitting portion) is provided so that a protrusion portion 54 (a to-be-fitted portion, see FIGS. 3A-3C) of the ink identification member 50 mounted on the ink cartridge 2 can be fitted to the fitting hole 38. Incidentally, the detailed configurations of the mounting portion 41 of the ink vessel 2*a* and the ink identification member 50 included in the display portion 40 will be described later.

When ink is ejected onto the paper P from the head 5 after the ink cartridge 2 is attached to the buffer tank 3 in such a manner, ink corresponding to the ejected ink is supplied from the buffer tank 3 to the head 5 through the supply tube 4. As the ink is supplied thus, the ink level in the buffer tank 3 drops so that the lower end open portion of the outside-air passageway portion 32 is exposed to the upper space in the buffer tank 3. As a result, the outside air is introduced into the ink cartridge 2 from the outside-air introduction pipe 36 through the upper space of the buffer tank 3 and the outside-air passageway portion 32.

When the outside air is introduced into the ink cartridge 2, the ink in the ink cartridge 2 is introduced into the buffer tank 3 through the ink introduction pipe 35. When the ink is introduced into the buffer tank 3, the ink level rises again in the buffer tank 3 so that the lower end open portion of the outside-air passageway portion 32 is immersed in the ink. As a result, the ink level in the buffer tank 3 is kept almost as high as the lower end open portion of the outside-air passageway portion 32. Incidentally, in this stationary state, the lower end open portion of the ink passageway portion 31 is immersed in the ink in the buffer tank 3, and the lower end open portion of the outside-air passageway portion 32 touches the ink surface in the buffer tank 3. After that, when all the ink in the ink cartridge 2 is used up, the ink in the buffer tank 3 is continuously consumed so that the ink level drops. Thus, the lower end open portion of the outside-air passageway portion 32 ceases from touching the ink.

The head 5 has a plurality of nozzles for ejecting ink. Accordingly, ink supplied from the buffer tank 3 to the head 5 through the supply tube 4 is ejected from a plurality of nozzles. That is, in a recording operation, with the reciprocating motion of the carriage 6, the head 5 reciprocates while ejecting ink. Thus, printing on the paper P is carried out.

Figure 3A:
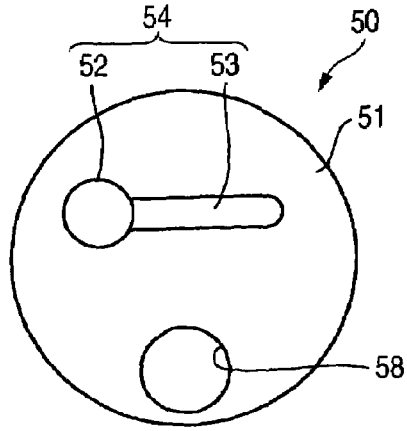
FIG. 3A is a top view of an ink identification member shown in FIG. 1.
Figure 3B:
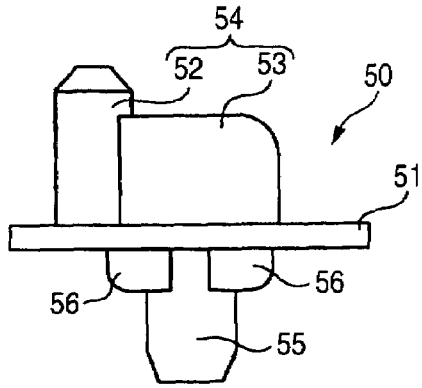
FIG. 3B is a side view of the ink identification member shown in FIG. 1.
Figure 3C:
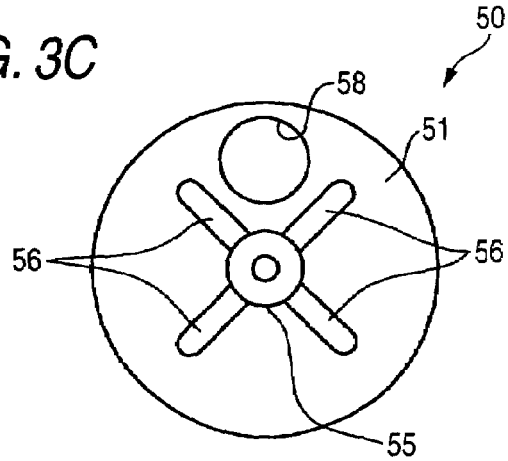
FIG. 3C is a bottom view of the ink identification member shown in FIG. 1.

Next, the detailed configurations of the mounting portion 41 of the ink vessel 2*a* and the ink identification member 50 included in the display portion 40 will be described with reference to FIGS. 2A-2B and FIGS. 3A-3C. FIGS. 2A and 2B are a top view and a cross-sectional view of the ink cartridge shown in FIG. 1. FIGS. 3A-3C are a top view, a side view and a bottom view of the ink identification member 50 shown in FIG. 1.

A circular recess portion 42 is provided in the ink injection surface 2*b* of the ink vessel 2*a* of the ink cartridge 2. The mounting portion 41 is provided in the bottom of the recess portion 42. The mounting portion 41 is an opening for mounting the ink identification member 50 in the ink vessel 2*a*. The mounting portion 41 is constituted by a substantially circular central groove 41*a* and four positioning grooves 41*b*. The central groove 41*a* is disposed on the extension of the two insertion portions 21 and 22 and formed coaxially with the recess portion 42. The positioning grooves 41*b* extend from the central groove 41*a* to the outside. Here, the four positioning grooves 41*b* are disposed at intervals of 90 degrees. Thus, the mounting portion 41 as a whole is formed substantially like a cross.

The display portion 40 is to display the kind of ink (which means the color of ink here) to be injected into the ink cartridge 2. The display portion 40 has a character portion 45 and the ink identification member 50. The character portion 45 is a circular region provided in the bottom of the recess portion 42 so as to surround the mounting portion 41 of the ink vessel 2*a*. The character portion 45 is imprinted with ink identification marks by molding. That is, the ink identification marks are four colors marks "K", "C", "Y" and "M" corresponding to the ink colors black, cyan, yellow and magenta for use in the inkjet printer 1. Here, the four color marks are disposed between adjacent ones of the four positioning grooves 41*b* of the mounting portion 41 of the ink vessel 2*a* respectively. That is, the four color marks are disposed at centers in sections divided by two perpendicular lines of the mounting portion 41 substantially shaped like a cross. In addition, the four color marks are arranged circumferentially around the central groove 41*a* and at intervals of 90 degrees.

The ink identification member 50 includes a cover member 51, a protrusion portion 54, a shaft portion 55 and engagement portions 56 as shown in FIGS. 3A-3C. The protrusion portion 54 projects on the upper surface of the cover member 51. The shaft portion 55 and the engagement portions 56 project on the lower surface of the cover member 51.

The cover member 51 is a circular disc-like member a little smaller than the recess portion 42. A circular through hole 58 is formed near an edge portion of the cover member 51. Incidentally, the through hole 58 of the cover member 51 is formed between two adjacent ones of the four engagement portions 56 in the lower surface of the cover member 51 (see FIG. 3C). Accordingly, when the ink identification member 50 is mounted in the mounting portion 41 of the ink vessel 2*a*, the cover member 51 can cover three of the four color marks in the character portion 45 so that only the other one of the color marks can be observed through the through hole 58. Thus, a worker can easily confirm the one color mark disposed in the through hole 58 of the cover member 51.

The protrusion portion 54 on the upper surface side of the cover member 51 is constituted by a columnar protrusion piece 52 and a plate-like protrusion piece 53. Here, the columnar protrusion piece 52 is disposed in a position (a position other than a central position) eccentric from the central position of the cover member 51. In addition, one end portion of the plate-like protrusion piece 53 is connected to the columnar protrusion piece 52. Incidentally, the shape of the protrusion portion 54 is substantially the same as the shape of a fitting hole of a mounting portion of the ink dispenser and the shape of a fitting hole of the buffer tank of the inkjet printer as will be described later.

The shaft portion 55 on the lower surface side of the cover member 51 is a substantially columnar member formed to project from the central position of the lower surface of the cover member 51. The four engagement portions 56 are plate-like members formed to project on the lower surface of the cover member 51. The four engagement portions 56 are provided to extend in the radial direction of the cover member 51 from the shaft portion 55 provided at the center of the cover member 51. The engagement portions 56 are disposed at intervals of 90 degrees. Thus, the shaft portion 55 and the four engagement portions 56 are formed substantially like a cross as a whole when the cover member 51 is observed from below. In addition, the projecting length of the shaft portion 55 from the lower surface of the cover member 51 is larger than that of the four engagement portions 56 likewise.

The outer diameter of the shaft portion 55 is almost as large as the diameter of a central groove 41*a* formed in the mounting portion 41 of the ink vessel 2*a*, so that the shaft portion 55 can be inserted into the central groove 41*a*. The width and length of the four engagement portions 56 are substantially equal to the width and length of the four positioning grooves 41*b* formed in the mounting portion 41 of the ink vessel 2*a* so that the four engagement portions 56 can be inserted into the positioning grooves 41*b*. Thus, when the shaft portion 55 and the four engagement portions 56 are inserted into the central groove 41*a* and the positioning portions 41*b*, the ink identification member 50 can be mounted in the mounting portion 41 of the ink vessel 2*a*.

Incidentally, the four engagement portions 56 have one and the same shape, and are formed at an equal angle with one another. Therefore, when the ink identification member 50 is mounted in the mounting portion 41 of the ink vessel 2*a*, four mounting modes can be set by rotating the ink identification member 50 by the angle of 90 degrees each time. In other words, the ink identification member 50 can be mounted in four rotational positions different from one another in the mounting portion 41. Here, among the four mounting modes, the positional relationship of the protrusion portion 54 on the upper surface of the ink identification member 50 with respect to the character portion 45 differs from one mounting mode to another (see FIGS. 5A-5D).

Figure 4A:
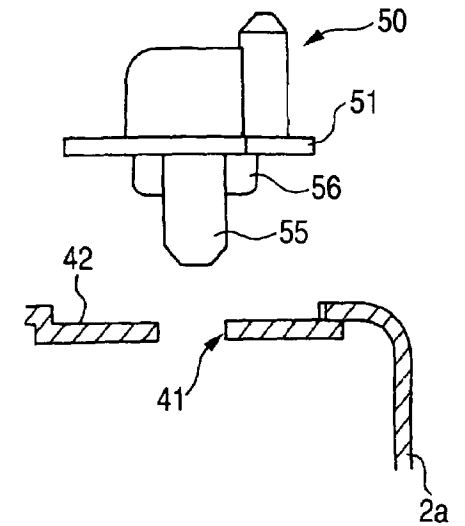
FIGS. 4A-4C are views for explaining the operation for mounting the ink identification member in a mounting portion of an ink vessel.
Figure 4B:
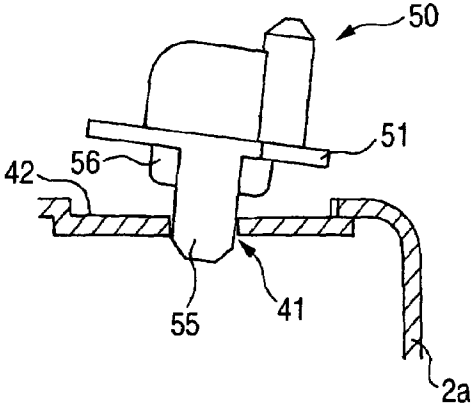
Figure 4C:
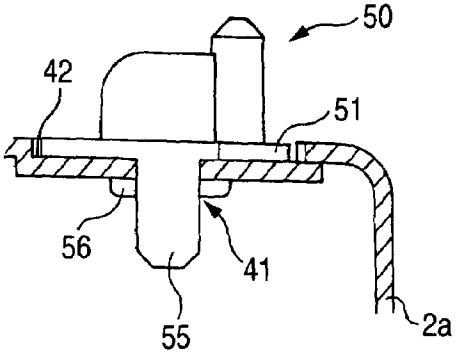

Next, the operation for mounting the ink identification member 50 in the mounting portion 41 of the ink vessel 2*a* during manufacturing of the ink cartridge 2 will be described with reference to FIGS. 4A-4C. FIGS. 4A-4C are diagrams for explaining the operation for mounting the ink identification member 50 in the mounting portion 41 of the ink vessel 2*a*.

First, the worker places the ink identification member 50 substantially above the mounting portion 41 of the ink vessel 2*a* as shown in FIG. 4A. Next, the worker inserts the vicinity of the front end portion of the shaft portion 55 of the ink identification member 50 into the central groove 41*a* of the mounting portion 41 of the ink vessel 2*a* as shown in FIG. 4B. Here, the worker confirms the kind of ink to be injected into the ink cartridge 2. Thus, the worker selects a color mark corresponding to the ink to be injected into the ink cartridge 2, that is, a color mark which will be observed through the through hole 58 when the ink identification member 50 is mounted.

In the state where the vicinity of the front end portion of the shaft portion 55 of the ink identification member 50 has been inserted into the central groove 41*a* of the mounting portion 41 of the ink vessel 2*a*, the worker rotates the ink identification member 50 around the shaft portion 55 so as to adjust the direction (rotational position) of the ink identification member 50. On this occasion, the worker adjusts the direction of the ink identification member 50 so that the through hole 58 of the ink identification member 50 is disposed on the color mark corresponding to the ink to be injected into the ink cartridge 2 while the four engagement portions 56 are inserted into the four positioning grooves 41*b* of the mounting portion 41.

After the direction of the ink identification member 50 is adjusted in such a manner, the worker perfectly inserts the four engagement portions 56 of the ink identification member 50 into the four positioning grooves 41*b* of the mounting portion 41 as shown in FIG. 4C. As a result, the ink identification member 50 is mounted on the ink vessel 2*a* in the state where the direction of the ink identification member 50 has been set to be a desired direction. In this event, the cover member 51 is received in the recess portion 42 so that only the protrusion portion 54 projects over the outer surface of the ink vessel 2*a*.

Here, FIGS. 5A-5D show top views of the ink cartridges 2 each having the ink identification member 50 mounted in the mounting portion 41 of the ink vessel 2*a*. FIGS. 5A-5D are top views of the ink cartridges to be injected with black, cyan, yellow and black inks respectively. As shown in FIGS. 5A-5D, one of the four color marks can be confirmed through the through hole 58 of the ink identification member 50.

Figure 5A:
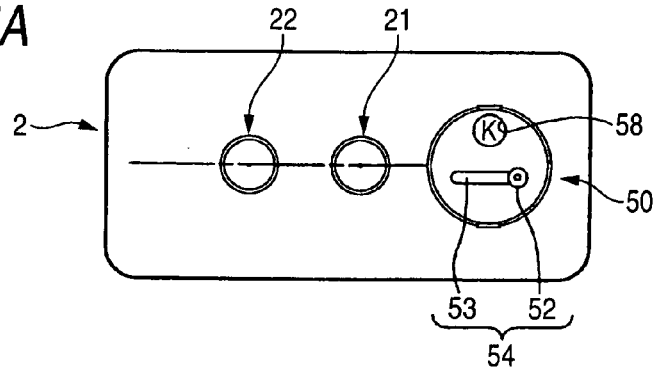
FIGS. 5A-5D are top views each showing the ink cartridge in which the ink identification member has been mounted on the ink vessel.

In the ink cartridge 2 to be injected with black ink, as shown in FIG. 5A, the color mark "K" formed in the character portion 45 can be confirmed through the through hole 58 of the ink identification member 50. On this occasion, the ink identification member 50 is disposed so that the protrusion portion 54 is parallel to the extension of the two insertions 21 and 22 while the columnar protrusion piece 52 is placed at a longer distance from the insertion portion 21 than the plate-like protrusion piece 53 (on the right side in FIG. 5A).

Figure 5B:
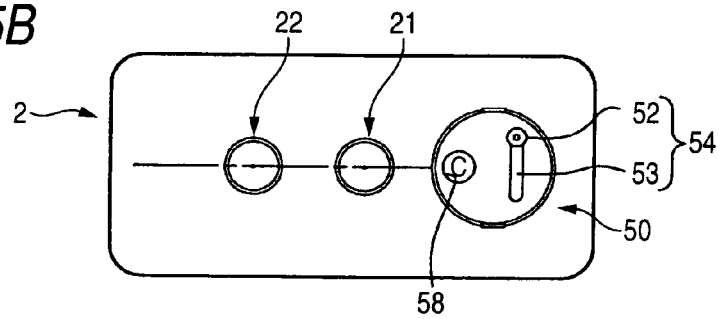

In the ink cartridge 2 to be injected with cyan ink, as shown in FIG. 5B, the color mark "C" formed in the character portion 45 can be confirmed through the through hole 58 of the ink identification member 50. On this occasion, the ink identification member 50 is disposed so that the protrusion portion 54 is perpendicular to the extension of the two insertions 21 and 22 while the columnar protrusion piece 52 is placed on one side with respect to the aforementioned extension (on the upper side with respect to the extension in FIG. 5B).

Figure 5C:
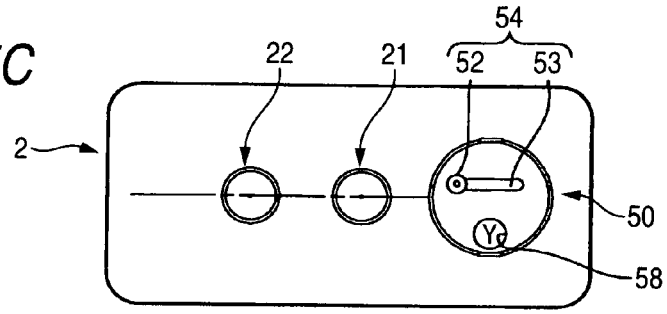

In the ink cartridge 2 to be injected with yellow ink, as shown in FIG. 5C, the color mark "Y" formed in the character portion 45 can be confirmed through the through hole 58 of the ink identification member 50. On this occasion, the ink identification member 50 is disposed so that the protrusion portion 54 is parallel to the extension of the two insertions 21 and 22 while the columnar protrusion piece 52 is placed to be closer to the insertion portion 21 than the plate-like protrusion piece 53 (on the left side in FIG. 5C).

Figure 5D:
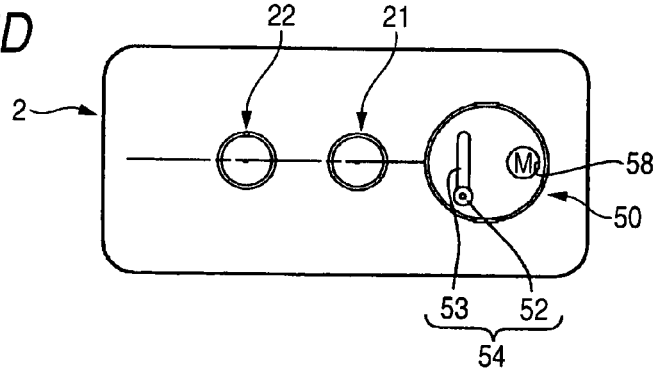

In the ink cartridge 2 to be injected with magenta ink, as shown in FIG. 5D, the color mark "M" formed in the character portion 45 can be confirmed through the through hole 58 of the ink identification member 50. On this occasion, the ink identification member 50 is disposed so that the protrusion portion 54 is perpendicular to the extension of the two insertions 21 and 22 while the columnar protrusion piece 52 is placed on the other side with respect to the aforementioned extension (on the lower side with respect to the extension in FIG. 5D).

In such a manner, the ink identification member 50 can be mounted in four different rotational positions in the mounting portion 41 of the ink vessel 2*a*, and the protrusion portion 54 of the ink identification member 50 can be set in four positions different from one another with respect to the two insertion portions 21 and 22 in accordance with the color of ink to be injected into the ink cartridge 2, that is, the color to be displayed through the through hole 58. In addition, only by selecting the color mark to be displayed through the through hole 58, the position of the protrusion 54 can be set in a position corresponding to the selected color. Accordingly, no special work only for setting the position of the protrusion portion 54 is not required, and the working cost can be reduced.

According to the ink cartridge 2 according to this embodiment as described above, four kinds of ink cartridges having a function (of the protrusion 54 which can be set in different positions) of preventing erroneous injection and a function (of the four color marks imprinted in the character portion 45 and the through hole 58) of displaying the kind of ink to be injected can be selectively made up using two kinds of parts, that is, one kind of ink vessel 2*a* and one kind of ink identification member 50. Thus, four kinds of ink cartridges in which erroneous ink injection is prevented and the kind of ink can be confirmed easily can be manufactured at a low cost.

Next, with reference to FIGS. 6A-6D and 7A-7D, description will be made on the configuration of the vicinity of the mounting portion of the ink dispenser for injecting ink into the ink cartridge 2 in the ink injection system according to this embodiment, and the operation for mounting the cartridge 2 in the mounting portion of the ink dispenser.

Figure 6A:
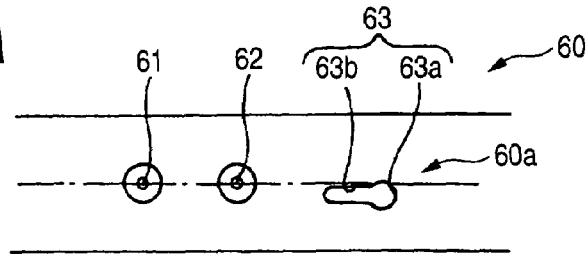
FIG. 6A is a top perspective view of the vicinity of a mounting portion of an ink dispenser.
Figure 6B:
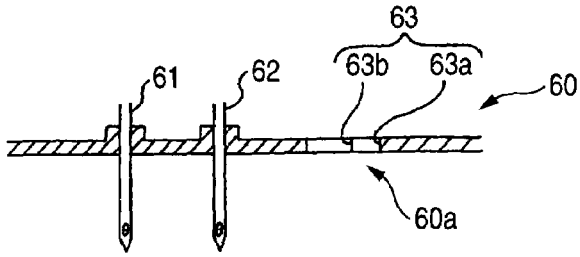
FIG. 6B is across-sectional view of the vicinity of the mounting portion of the ink dispenser.
Figure 6C:
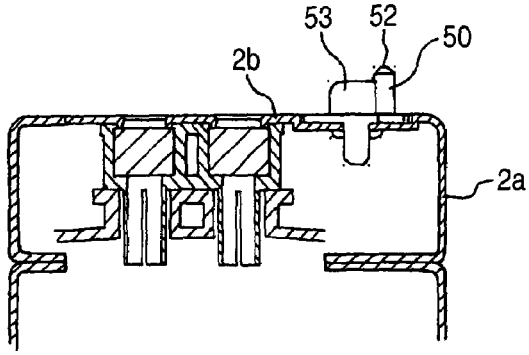
FIG. 6C is a view showing the ink cartridge 2 just before it is mounted in the mounting portion of the ink dispenser.

Incidentally, FIGS. 6A-6D show not only the schematic configuration of the vicinity of a mounting portion 60*a* of the ink dispenser 60 for injecting black ink, but also the case where the ink cartridge 2 to be injected with black ink is mounted in the mounting portion 60*a*. FIGS. 6A and 6B are a top perspective view and a cross-sectional view of the vicinity of the mounting portion 60*a* of the ink dispenser 60. FIG. 6C is a view showing the ink cartridge 2 just before it is mounted in the mounted portion 60*a* of the ink dispenser 60. FIG. 60D is a view showing the state where the ink cartridge 2 has been mounted in the mounted portion 60*a* of the ink dispenser 60.

A hollow-needle-like injection nozzle 61 for injecting ink into the ink cartridge 2 and a hollow-needle-like air vent nozzle 62 for removing the air from the inside of the ink cartridge 2 to the outside are provided in the mounting portion 60*a* of the ink dispenser 60. Accordingly, when the ink cartridge 2 is mounted in the mounting portion 60*a* of the ink dispenser 60, the injection nozzle 61 and the air vent nozzle 62 pierce the stoppers 23 and 24 of the two insertion portions 21 and 22 of the ink cartridge 2 and enter the inside of the ink cartridge 2.

In the mounting portion 60*a* of the ink dispenser 60 for injecting black ink, a fitting hole 63 is provided in the vicinity of the extension of the injection nozzle 61 and the air vent nozzle 62. The fitting hole 63 is constituted by a circular portion 63*a* and an elongated portion 63*b*. The diameter of the circular portion 63*a* is substantially equal to the outer diameter of the columnar protrusion piece 52 of the protrusion portion 54 of the ink identification member 50, and the width and length of the elongated portion 63*b* are substantially equal to the width and length of the plate-like protrusion piece 53. Accordingly, the shape of the fitting hole 63 is substantially the same as the shape of the protrusion portion 54 of the ink identification member 50.

The fitting hole 63 is disposed (on the right side in FIG. 7A) to be parallel to the extension of the injection nozzle 61 and the air vent nozzle 62 and to put the circular portion 63*a* at a longer distance from the air vent nozzle 62 than the elongated portion 63*b*. In such a manner, in the mounting portion 60*a*, the positional relationship of the fitting hole 63 with respect to the extension of the injection nozzle 61 and the air vent nozzle 62 substantially agrees with the positional relationship of the protrusion portion 54 of the ink identification member 50 with respect to the insertion portions 21 and 22 of the ink cartridge 2 to be injected with black ink (see FIG. 5A).

Figure 6D:
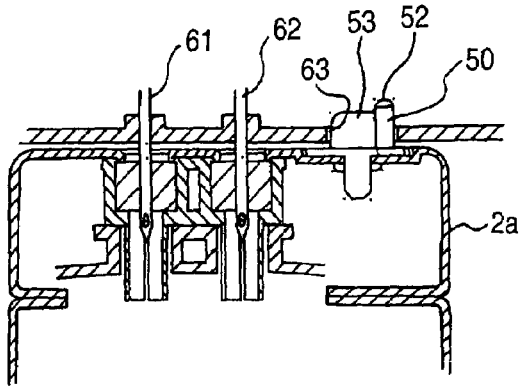
FIG. 6D is a view showing the ink cartridge 2 which has been mounted in the mounting portion of the ink dispenser.

Accordingly, the ink cartridge 2 to be injected with black ink as shown in FIG. 6C, that is, the ink cartridge 2 having the ink identification member 50 mounted in the mounting portion 41 of the ink vessel 2*a* so as to observe the color mark "K" through the through hole 58 is made close to the mounting portion 60*a* of the ink dispenser 60, and the injection nozzle 61 and the air vent nozzle 62 are made to pierce the stoppers 23 and 24 respectively. As a result, as shown in FIG. 6D, the protrusion portion 54 of the ink identification member 50 is fitted into the fitting hole 63 of the mounting portion 60*a*. Thus, the attachment of the ink cartridge 2 to the mounting portion 60*a* of the ink dispenser 60 is completed.

Here, consider the case where the ink cartridge 2 to be injected with color ink other than black ink, that is, the ink cartridge 2 having the ink identification member 50 mounted in the mounting portion 41 of the ink vessel 2*a* so as to observe one of the color marks "C", "Y" and "M" through the through hole 58 is made close to the mounting portion 60*a* of the ink dispenser 60.

In this event, the positional relationship of the fitting hole 63 with respect to the injection nozzle 61 and the air vent nozzle 62 in the mounting portion 60*a* of the ink dispenser 60 for injecting black ink is different from the positional relationship of the protrusion portion 54 of the ink identification member 50 with respect to the insertion portions 21 and 22 of the ink cartridge 2 to be injected with color ink (see FIGS. 5B-5D). Therefore, even when the injection nozzle 61 and the air vent nozzle 62 are made to pierce the stoppers 23 and 24 respectively, the protrusion portion 54 of the ink identification member 50 is not fitted into the fitting hole 63 of the mounting portion 60*a*. Thus, only the ink cartridge 2 to be injected with black ink can be mounted in the mounting portion 60*a* of the ink dispenser 60 for injecting black ink. There is no fear that the ink cartridge 2 to be injected with color ink other than black ink is mounted.

Figure 7A:
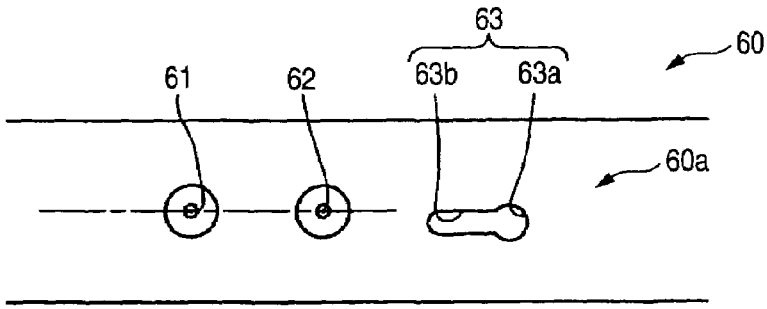
FIG. 7A is a view showing the configuration of the mounting portion of an ink dispenser for injecting black ink.
Figure 7B:
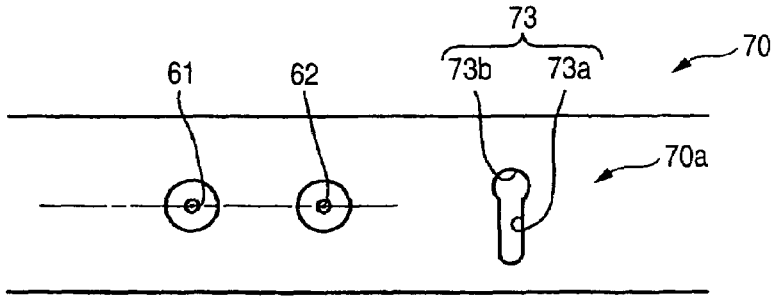
FIG. 7B is a view showing the configuration of the mounting portion of an ink dispenser for injecting cyan ink.
Figure 7C:
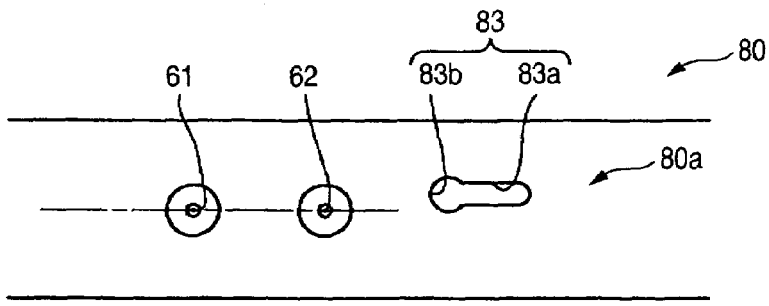
FIG. 7C is a view showing the configuration of the mounting portion of an ink dispenser for injecting yellow ink.
Figure 7D:
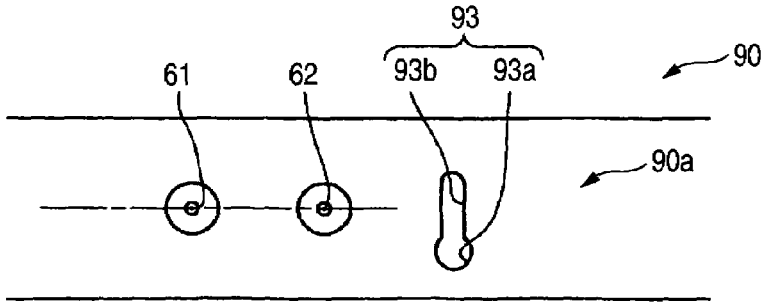
FIG. 7D is a view showing the configuration of the mounting portion of an ink dispenser for injecting magenta ink.

FIGS. 7A-7D show top perspective views of the vicinities of mounting portions of ink dispensers for injecting four color inks respectively. FIG. 7A is a view showing the configuration of the mounting portion 60*a* of the ink dispenser 60 for injecting black ink, correspondingly to FIG. 6A. In the same manner, FIGS. 7B-7D are views showing the configurations of mounting portions 70*a*, 80*a* and 90*a* of ink dispensers 70, 80 and 90 for injecting cyan, yellow and magenta inks respectively.

As for each of the mounting portions 70*a*, 80*a* and 90*a* of the ink dispensers 70, 80 and 90 for injecting cyan, yellow and magenta inks respectively, an injection nozzle 61 and an air vent nozzle 62 are provided in the same manner as those in the mounting portion 60*a* of the ink dispenser 60 for injecting black ink.

In each of the mounting portions 70*a*, 80*a* and 90*a* of the ink dispensers 70, 80 and 90 for injecting cyan, yellow and magenta inks respectively, a fitting hole 73, 83, 93 is provided in the vicinity of the extension of the injection nozzle 61 and the air vent nozzle 62. The fitting hole 73, 83, 93 is constituted by a circular portion 73*a*, 83*a*, 93*a* and an elongated portion 73*b*, 83*b*, 93*b*. The diameter of the circular portion 73*a*, 83*a*, 93*a* is substantially equal to the outer diameter of the columnar protrusion piece 52 of the protrusion portion 54 of the ink identification member 50, and the width and length of the elongated portion 73*b*, 83*b*, 93*b* are substantially equal to the width and length of the plate-like protrusion piece 53. Accordingly, the shape of the fitting hole 73, 83, 93 is substantially the same as the shape of the protrusion portion 54 of the ink identification member 50.

The fitting hole 73 of the ink dispenser 70 is disposed to be perpendicular to the extension of the injection nozzle 61 and the air vent nozzle 62 and to put the circular portion 73*a* on one side with respect to the aforementioned extension (on the upper side with respect to the aforementioned extension in FIG. 7B). In such a manner, in the mounting portion 70*a* of the ink dispenser 70, the positional relationship of the fitting hole 73 with respect to the injection nozzle 61 and the air vent nozzle 62 substantially agrees with the positional relationship of the protrusion portion 54 of the ink identification member 50 with respect to the insertion portions 21 and 22 of the ink cartridge 2 to be injected with cyan ink (see FIG. 5B).

The fitting hole 83 of the ink dispenser 80 is disposed (on the right side in FIG. 7C) to be parallel to the extension of the injection nozzle 61 and the air vent nozzle 62 and to make the circular portion 83*a* closer to the air vent nozzle 62 than the elongated portion 83*b*. In such a manner, in the mounting portion 80*a* of the ink dispenser 80, the positional relationship of the fitting hole 83 with respect to the injection nozzle 61 and the air vent nozzle 62 substantially agrees with the positional relationship of the protrusion portion 54 of the ink identification member 50 with respect to the insertion portions 21 and 22 of the ink cartridge 2 to be injected with yellow ink (see FIG. 5C).

The fitting hole 93 of the ink dispenser 90 is disposed to be perpendicular to the extension of the injection nozzle 61 and the air vent nozzle 62 and to put the circular portion 93*a* on the other side with respect to the aforementioned extension (on the lower side with respect to the aforementioned extension in FIG. 7D). In such a manner, in the mounting portion 90*a* of the ink dispenser 90, the positional relationship of the fitting hole 93 with respect to the injection nozzle 61 and the air vent nozzle 62 substantially agrees with the positional relationship of the protrusion portion 54 of the ink identification member 50 with respect to the insertion portions 21 and 22 of the ink cartridge 2 to be injected with magenta ink (see FIG. 5D).

Thus, only the ink cartridge 2 to be injected with cyan ink can be mounted in the mounting portion 70*a* of the ink dispenser 70 for injecting cyan ink. Only the ink cartridge 2 to be injected with yellow ink can be mounted in the mounting portion 80*a* of the ink dispenser 80 for injecting yellow ink. Only the ink cartridge 2 to be injected with magenta ink can be mounted in the mounting portion 90*a* of the ink dispenser 90 for injecting magenta ink. As a result, any ink cartridge 2 to be injected with black, cyan, yellow or magenta ink can be mounted only in the mounting portion of an ink dispenser for injecting the color ink. Thus, there is no fear that any ink cartridge 2 to be injected with its corresponding color ink is erroneously mounted in the mounting portion of an ink dispenser for injecting another ink.

In such a manner, the ink cartridges 2 to be injected with black, cyan, yellow and magenta inks are mounted in the mounting portions of ink dispensers corresponding to the colors respectively, and injected with the color inks. Thus, manufacturing the ink cartridges 2 is completed. After that, the ink cartridges 2 are attached to the inkjet printer 1 when recording is performed. Here, in the inkjet printer 1, four buffer tanks 3 are provided correspondingly to black, cyan, yellow and magenta respectively.

Here, in each buffer tank 3, as described above, the ink introduction pipe 35 and the outside-air introduction pipe 36 are disposed to project from the ceiling wall 3*a* of the buffer tank 3. In each of the buffer tanks 3 corresponding to black, cyan, yellow and magenta, a fitting hole 38 is provided in the vicinity of the extension of the ink introduction pipe 35 and the outside-air introduction pipe 36 as shown in FIG. 1. Incidentally, the shape of the fitting hole 38 is almost the same as the shape of the protrusion portion 54 of the ink identification member 50.

The positional relationship of the fitting hole 38 with respect to the ink introduction pipe 35 and the outside-air introduction pipe 36 of the buffer tank 3 corresponding to black, cyan, yellow or magenta substantially agrees with the positional relationship of the protrusion portion 54 of the ink identification member 50 with respect to the insertion portions 21 and 22 of the ink cartridge 2 of the inkjet printer 1, the ink cartridge 2 being injected with corresponding black, cyan, yellow or magenta ink. Incidentally, the positional relationship of the fitting hole 38 with respect to the ink introduction pipe 35 and the outside-air introduction pipe 36 of the buffer tank 3 corresponding to black, cyan, yellow or magenta is similar to the positional relationship of the fitting hole with respect to the injection nozzle 61 and the air vent nozzle 62 of the mounting portion of the ink dispenser corresponding to the black, cyan, yellow or magenta. Thus, detailed description thereof will be omitted (see FIGS. 7A-7D).

As a result, when the ink cartridge 2 injected with black, cyan, yellow or magenta ink is attached to the inkjet printer 1, the ink cartridge 2 can be mounted only on the buffer tank 3 corresponding to the kind of ink displayed on the display portion 40 of the ink cartridge 2. Thus, there is no fear that the ink cartridge 2 injected with its corresponding color ink is erroneously mounted on the buffer tank 3 corresponding to different color.

In such a manner, in the ink injection system according to this embodiment, a worker can easily confirm the kind of ink to be injected into the ink cartridge 2 through the character portion 45 of the display portion 40 before injecting ink into the ink cartridge 2 by means of an ink dispenser. In addition, a fitting hole which can be fitted to the protrusion portion 54 having a positional relationship corresponding to the kind of ink to be injected into the ink cartridge 2 is provided in the mounting portion of each ink dispenser for injecting black, cyan, yellow or magenta ink. As a result, only when the protrusion portion 54 of the ink identification member 50 of the ink cartridge 2 is fitted into the fitting hole of the ink dispenser corresponding to the kind of ink to be injected into the ink cartridge 2, the ink dispenser is allowed to inject ink. Accordingly, ink different from ink corresponding to a color mark which can be confirmed through the through hole 58 among color marks displayed on the character portion 45 of the display portion 40 of the ink cartridge 2 can be prevented from being erroneously injected into the ink cartridge 2. Further, also after ink injection, the kind of ink injected into the ink cartridge 2 can be confirmed easily on the display portion 40.

In addition, the protrusion portion 54 having a positional relationship corresponding to the kind of ink to be injected into the ink cartridge 2 can be also fitted into the fitting hole 38 provided in the buffer tank 3 corresponding to the kind of ink in the inkjet printer 1. As a result, when the ink cartridge 2 is attached to the inkjet printer 1, the ink cartridge 2 can be prevented from being erroneously attached to the inkjet printer 1 in a mounting position for another ink cartridge 2 injected with a different kind of ink from the kind displayed on the display portion 40 of the ink cartridge 2 in question. In addition, in this event, the protrusion portion 54 can be used in common in order to prevent ink from being erroneously injected by the ink dispenser and to prevent the ink cartridge 2 from being erroneously attached to the inkjet printer 1. Accordingly, the manufacturing process can be simplified, and the manufacturing cost can be reduced.

In other words, the to-be-detected portion according to this embodiment can be also detected by an ink identifying unit provided in an inkjet printer to be mounted with the cartridge body and for identifying the kind of ink injected into the cartridge body.

According to this configuration, in the inkjet printer, the to-be-detected portion provided in accordance with the kind of ink in the ink cartridge is detected by the ink identifying unit so as to identify the kind of ink injected into the ink cartridge. As a result, when the ink cartridge is mounted in the inkjet printer, the ink cartridge can be prevented from being erroneously mounted in a mounting position of a different kind of ink from the kind displayed in the display portion of the ink cartridge in the inkjet printer. In addition, in this event, a common to-be-detected portion can be used in order to prevent erroneous ink injection in the ink injector and erroneous mounting of the ink cartridge in the inkjet printer. Thus, in comparison with the case where a plurality of to-be-detected portions are provided, the manufacturing process can be simplified, and the manufacturing cost can be reduced.

More particularly, the to-be-detected portion is a protrusion portion 54 provided in a predetermined position of the cover member 51.

According to this configuration, due to the protrusion portion 54 provided as the to-be-detected portion in a predetermined position of the cover member 51, the position of the to-be-detected portion can be set in a position corresponding to one ink identification mark selected from the plurality of ink identification marks only if the mounting position of the cover member is set to expose the selected ink identification mark. Accordingly, the work of setting the position of the to-be-detected portion in a position corresponding to the selected color (ink identification mark) is dispensable. In addition, in comparison with the case where the to-be-detected portion as a separate part is attached to the cover member, the number of parts can be reduced so that the manufacturing cost can be reduced.

In addition, the display portion 40 includes the character portion 45 having four color marks formed therein, and the ink identification member 50 attached onto the character portion 45. When the ink identification member 50 is mounted in the mounting portion 41 of the ink vessel 2*a*, one of the four color marks can be displayed by changing the attachment position (rotational position) of the ink identification member 50. Accordingly, without using ink vessels 2*a* and ink identification members 50 differently for each of the four color marks, a common ink vessel 2*a* and a common ink identification member 50 can be used regardless of the kind of ink.

In addition, the protrusion portion 54 of the ink identification member 50 of the ink cartridge 2 is designed to be fitted into the fitting hole of the mounting portion of the ink dispenser. Accordingly, in comparison with the case where a to-be-fitted portion as a separate part is attached to the ink identification member 50, the number of parts can be reduced so that the manufacturing cost can be reduced.

In addition, when the ink identification member 50 is rotated around its shaft portion 55, among the four color marks, one color mark corresponding to the kind of ink to be injected by the ink dispenser can be selected easily.

In addition, in the lower surface of the ink identification member 50, the projecting length of the shaft portion 55 is larger than the projecting length of each of the engagement portions 56. Accordingly, when the ink identification member 50 is mounted in the mounting portion 41 of the ink vessel 2*a*, the shaft portion 55 is first inserted into the mounting portion 41, and the ink identification member 50 is rotated around the shaft portion 55 so that the position of the through hole 58 is adjusted to a position corresponding to the color mark of the ink to be injected by the ink dispenser. After that, the engagement portions 56 can be engaged with the positioning grooves 41*b*. Thus, the work of attaching the ink identification member 50 to the ink vessel 2*a* becomes easy.

Although the preferred embodiment of the invention has been described above, the invention is not limited to the embodiment, but can be changed in design variously as long as it is within the scope stated in claims. For example, in the aforementioned embodiment, the protrusion portion 54 having a positional relationship corresponding to the kind of ink to be injected into the ink cartridge 2 can be also fitted into the fitting hole 38 provided in the buffer tank 3 corresponding to the kind of ink in the inkjet printer 1. However, the protrusion portion 54 can be allowed to be not fitted into the fitting hole of the buffer tank 3 of the inkjet printer 1 as long as the protrusion portion 54 is fitted into the fitting hole of the mounting portion of the ink dispenser. Incidentally, another protrusion portion which can be fitted into the fitting hole of the buffer tank 3 of the inkjet printer 1 may be provided for the ink cartridge 2 separately from the protrusion portion 54 which can be fitted into the fitting hole of the mounting portion of the ink dispenser.

In the aforementioned embodiment, when the ink identification member 50 is mounted in the mounting portion 41 of the ink vessel 2*a*, one of the four color marks corresponding to black, cyan, yellow and magenta inks can be displayed by changing the attachment position of the cover member 51. However, the ink identification member may be formed integrally with the ink vessel in accordance with each ink of black, cyan, yellow and magenta.

In the aforementioned embodiment, the projecting length of the shaft portion 55 is larger than the projecting length of each engagement portion 56 in the lower surface of the ink identification member 50. However, the projecting length of the shaft portion 55 may be equal to or smaller than the projecting length of each engagement portion 56.

Although number of kinds of inks is four in the aforementioned embodiment, the invention is not limited to this, and the number of kinds of ink may be not larger than three or not smaller than five. For example, when the invention is applied to the case where the number of kinds of inks is six, it will go well if six positioning grooves 41*b* and six engagement portions 56 are disposed at intervals of 60 degrees, and six characters are imprinted in the character portion 45 at intervals of 60 degrees.

In the aforementioned embodiment, the protrusion portion 54 having a positional relationship corresponding to the kind of ink in the ink identification member 50 of the ink cartridge 2 is fitted into the fitting hole of the mounting portion of the ink dispenser corresponding to the kind of ink in question so that erroneous injection of ink in the ink dispenser is prevented. However, the ink cartridge 2 may have a to-be-detected portion provided in a position differing in accordance with the kind of ink. In this case, the to-be-detected portion is detected by an ink identifying unit of the ink dispenser so as to prevent erroneous injection of ink in the ink dispenser.

Figure 8:
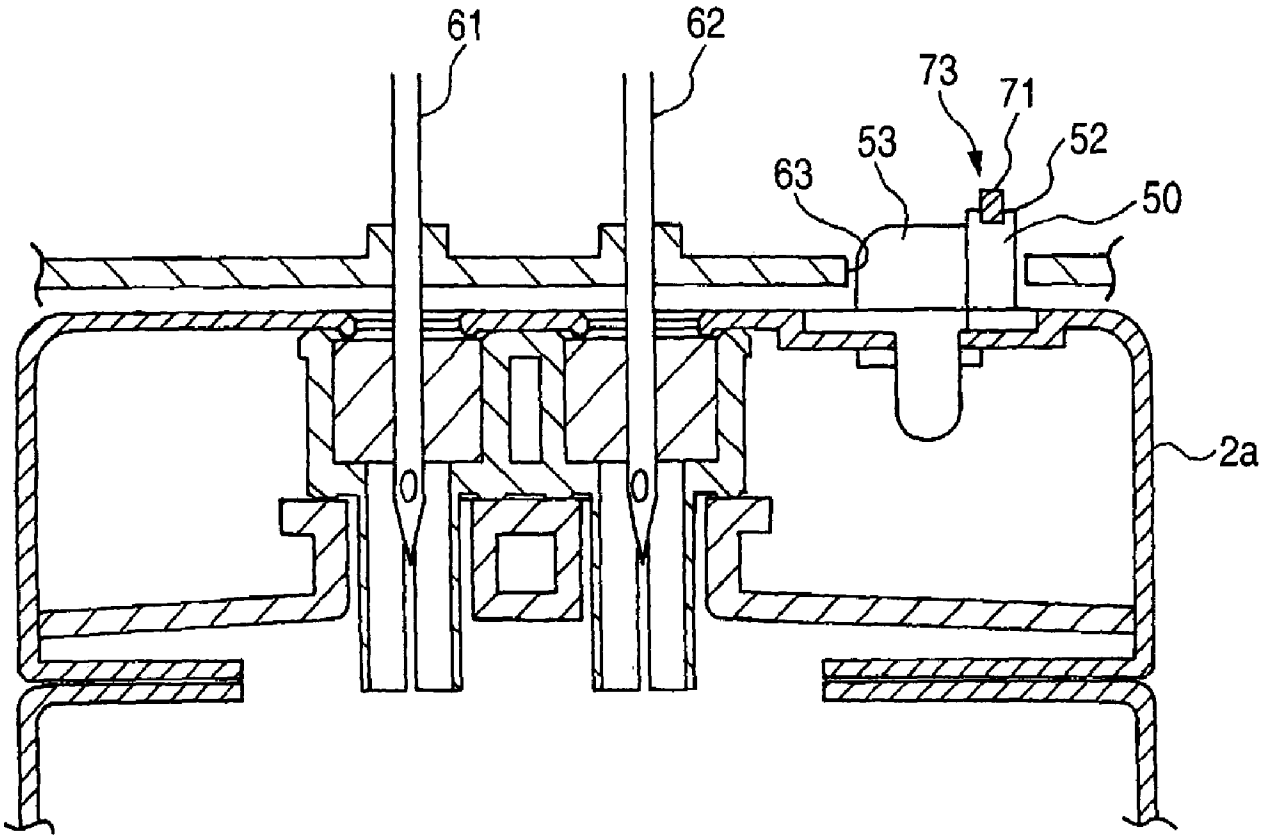
FIG. 8 is a diagram showing the state where the ink cartridge to be injected with black ink is mounted in the mounting portion of the ink dispenser for injecting black ink.

For example, in the aforementioned embodiment, the protrusion portion 54 provided in a position differing in accordance with the kind of ink to be injected may serve as the to-be-detected portion, while an ink identifying unit for detecting the to-be-detected portion is provided in the ink dispenser. This case will be described with reference to FIGS. 8 and 9A-9D. FIG. 8 shows the case where the ink cartridge 2 to be injected with black ink is mounted in the mounting portion 60*a* of the ink dispenser 60 for injecting black ink. FIGS. 9A-9D show the positional relationships between the ink identifying units provided in the mounting portions 60*a*, 70*a*, 80*a* and 90*a* of the ink dispensers 60, 70, 80 and 90 corresponding to black, cyan, yellow and magenta inks respectively, and the ink cartridges 2 mounted in the mounting portions 60*a*, 70*a*, 80*a* and 90*a* respectively.

Figure 9A:
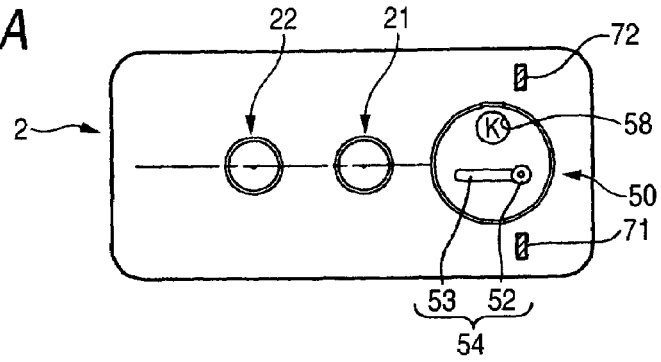
FIGS. 9A-9D are views showing the positional relationships between ink identifying units provided in the mounting portions of the ink dispensers corresponding to the four colors, that is, black, cyan, yellow and magenta respectively, and the ink cartridges mounted in the mounting portions respectively.
Figure 9B:
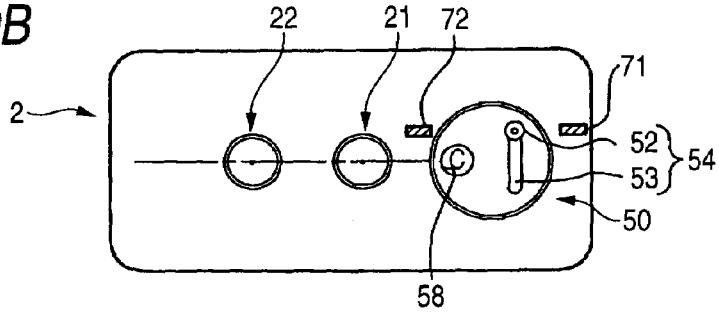
Figure 9C:
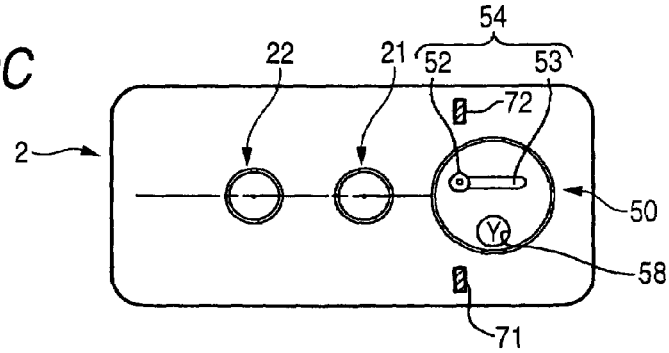
Figure 9D:
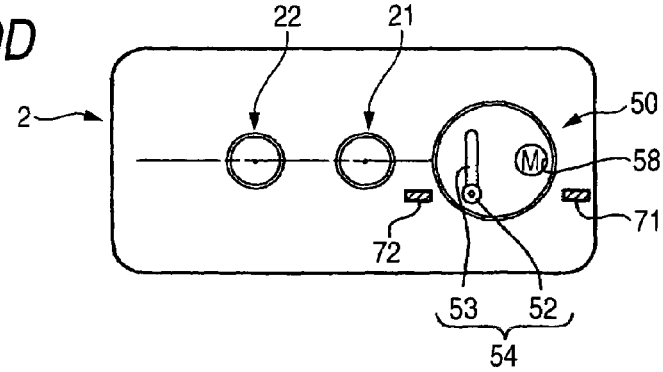

Each ink identifying unit is constituted by a transmission type photo-sensor 73 provided in the ink dispenser. The photo-sensor 73 is constituted by a light emitting portion 71 and a light receiving portion 72. As shown in FIGS. 8 and 9A, in the mounting portion 60*a* of the ink dispenser 60 to be mounted with the ink cartridge 2 corresponding to black, the photo-sensor 73 is provided in a position where it can detect the front end of the columnar protrusion piece 52 of the mounted ink cartridge 2 corresponding to black. More specifically, the light emitting portion 71 and the light receiving portion 72 of the photo-sensor 73 are disposed to put the front end of the columnar protrusion piece 52 therebetween on a virtual straight line crossing the extension of the injection nozzle 61 and the air vent nozzle 62 at right angles and passing the front end of the columnar protrusion piece 52 in a position higher than the plate-like protrusion piece 53 of the ink cartridge 2 attached to the ink dispenser 60. Thus, the photo-sensor 73 is disposed so that light is not blocked by the plate-like protrusion piece 53, but light is blocked by the front end of the columnar protrusion piece 52 only when the ink cartridge 2 corresponding to black is mounted in the mounting portion 60*a*.

In the mounting portion 70*a* of the ink dispenser 70 to be mounted with the ink cartridge 2 corresponding to cyan, the light emitting portion 71 and the light receiving portion 72 are disposed to put the front end of the columnar protrusion piece 52 therebetween on a virtual straight line parallel to the extension of the injection nozzle 61 and the air vent nozzle 62 and passing the front end of the columnar protrusion piece 52 in a position higher than the plate-like protrusion piece 53 of the ink cartridge 2 attached to the ink dispenser 70. Thus, the photo-sensor 73 is disposed so that light is not blocked by the plate-like protrusion piece 53, but light is blocked by the front end of the columnar protrusion piece 52 only when the ink cartridge 2 corresponding to cyan is mounted in the mounting portion 70*a*.

In the mounting portion 80*a* of the ink dispenser 80 to be mounted with the ink cartridge 2 corresponding to yellow, the light emitting portion 71 and the light receiving portion 72 are disposed to put the front end of the columnar protrusion piece 52 therebetween on a virtual straight line crossing the extension of the injection nozzle 61 and the air vent nozzle 62 at right angles and passing the front end of the columnar protrusion piece 52 in a position higher than the plate-like protrusion piece 53 of the ink cartridge 2 attached to the ink dispenser 80. Thus, the photo-sensor 73 is disposed so that light is not blocked by the plate-like protrusion piece 53, but light is blocked by the front end of the columnar protrusion piece 52 only when the ink cartridge 2 corresponding to yellow is mounted in the mounting portion 80*a*.

In the mounting portion 90*a* of the ink dispenser 90 to be mounted with the ink cartridge 2 corresponding to magenta, the light emitting portion 71 and the light receiving portion 72 are disposed to put the front end of the columnar protrusion piece 52 therebetween on a virtual straight line parallel to the extension of the injection nozzle 61 and the air vent nozzle 62 and passing the front end of the columnar protrusion piece 52 in a position higher than the plate-like protrusion piece 53 of the ink cartridge 2 attached to the ink dispenser 90. Thus, the photo-sensor 73 is disposed so that light is not blocked by the plate-like protrusion piece 53, but light is blocked by the front end of the columnar protrusion piece 52 only when the ink cartridge 2 corresponding to magenta is mounted in the mounting portion 90*a*.

In such a manner, the to-be-detected portion (columnar protrusion piece 52) is detected by the ink identifying unit (photo-sensor 73) of the ink dispenser so that the suitability of the kind of ink of the ink cartridge mounted in the mounting portion 60*a*, 70*a*, 80*a*, 90*a* is recognized. Due to such a configuration, it is possible to recognize that a different kind of ink cartridge is attached erroneously, and to prevent erroneous injection from occurring.

Further, a control unit of the ink dispenser may control to allow the ink injection unit to operate in response to a detection signal transmitted when the ink identifying unit detects the to-be-detected portion, and to inhibit the ink injection unit from operating when the detection signal is not received. In such a manner, an injection inhibiting unit for preventing erroneous injection perfectly can be arranged. Incidentally, the to-be-detected portion is not limited to the columnar protrusion piece 52, but may be a notch, a bar code or the like. The ink identifying unit is not limited to the transmission type photo-sensor 73, but may be a reflection type photo-sensor or a bar code reader.

In this manner, the ink injection system according to the embodiment includes an injection inhibiting unit for inhibiting the ink cartridge from being erroneously injected with a different kind of ink from the ink identified by the ink identifying unit.

With this configuration, the ink cartridge 2 is inhibited from being erroneously injected with a different kind of ink from the ink identified by the ink identifying unit. Accordingly, in the ink injector, the ink cartridge can be surely prevented from being erroneously injected with a different kind of ink from the kind displayed on the display portion of the ink cartridge.

What is claimed is:

1. An ink cartridge comprising:

a cartridge body to be injected with predetermined ink by an ink injector, the predetermined ink being one of a plurality of kinds of inks;

a display portion for displaying the kind of the predetermined ink to be injected; and a to-be-detected portion to be detected when the predetermined ink to be injected is identified in the ink injector to be mounted with the cartridge body, the to-be-detected portion being a different portion from the display portion and being provided in a position corresponding to the predetermined ink displayed by the display portion, the position being one of a plurality of different positions corresponding to the plurality of kinds of inks, wherein the display portion includes a plurality of ink identification marks corresponding to the plurality of kinds of inks respectively, and one ink identification mark of the plurality of ink identification marks is selected to be displayed, and wherein the position of the to-be-detected portion is selected from the plurality of different positions in accordance with the selection of the one ink identification mark from the plurality of ink identification marks in the display portion.

2. An ink-cartridge ink injection system comprising:

the ink cartridge according to claim 1; and an ink injector for injecting the predetermined ink into the ink cartridge, the ink injector including an ink identifying unit for detecting the to-be-detected portion to thereby identify the kind of ink to be injected into the ink cartridge before injecting ink into the ink cartridge.

3. The ink injection system according to claim 2, further comprising:

an injection inhibiting unit for inhibiting the ink cartridge from being erroneously injected with a different kind of ink from the ink identified by the ink identifying unit.

4. The ink cartridge according to claim 1, wherein the to-be-detected portion can be also detected by an ink identifying unit provided in an inkjet printer to be mounted with the cartridge body and for identifying the kind of ink injected into the cartridge body.

5. The ink cartridge according to claim 1, wherein:

the plurality of ink identification marks is put on a surface of the cartridge body, and the display portion further includes a cover member attached to the cartridge body so as to cover all of the ink identification marks except the one ink identification mark selected from the plurality of ink identification marks.

6. The ink cartridge according to claim 5, wherein the to-be-detected portion is a protrusion portion provided in a predetermined position of the cover member.

7. The ink cartridge according to claim 5, wherein:

the plurality of ink identification marks are arranged circumferentially and disposed in a circle, the cover member includes a shaft portion formed to project on a back surface of the cover member and to be rotatably mounted in a mounting hole formed in a central portion of the circle formed by the plurality of ink identification marks in the cartridge body, and a window portion formed in an outer portion of the cover member so that the one ink identification mark selected from the plurality of ink identification marks can be observed from outside when the cover member has been attached to the cartridge body, and the cover member is rotated around the shaft portion so that the window portion can be aligned with a position of one of the ink identification marks corresponding to the predetermined ink to be injected.

8. The ink cartridge according to claim 7, wherein:

a plurality of positioning grooves for positioning the cover member in a rotating direction thereof are formed in the cartridge body, a plurality of projecting engagement portions are formed to project on the back surface of the cover member so that the plurality of projecting engagement portions can engage with the plurality of positioning grooves respectively, and projecting length of the shaft portion on the back surface of the cover member is larger than that of each of the plurality of projecting engagement portions likewise.

9. An ink cartridge comprising:

a cartridge body to be injected with predetermined ink by an ink injector, the predetermined ink being one of a plurality of kinds of inks;

a display portion for displaying the kind of the predetermined ink to be injected; and a to-be-fitted portion being a different portion from the display portion and being provided in a position corresponding to the predetermined ink displayed by the display portion, the position being one of a plurality of different positions corresponding to the plurality of kinds of inks;

wherein the cartridge body is allowed to be injected with ink by the ink injector when the to-be-fitted portion is fitted to a fitting portion of the ink injector corresponding to the kind of the predetermined ink, wherein the display portion includes a plurality of ink identification marks corresponding to the plurality of kinds of inks respectively, and the one ink identification mark of the plurality of ink identification marks is selected to be displayed, and wherein the position of the to-be-fitted portion is selected from the plurality of different positions in accordance with the selection of the one ink identification mark from the plurality of ink identification marks in the display portion.

10. An ink-cartridge ink injection system comprising:

the ink cartridge according to claim 9; and an ink injector for injecting the predetermined ink into the ink cartridge, the ink injector including a mounting portion to be mounted with the ink cartridge, and an injecting unit for injecting the predetermined ink into the ink cartridge mounted on the mounting portion, the mounting portion including a fitting portion capable of fitting only to the to-be-fitted portion of the ink cartridge to be injected with the predetermined ink.

11. The ink cartridge according to claim 9, wherein the to-be-fitted portion can be fitted to a fitting portion provided in an inkjet printer to be mounted with the cartridge body, the fitting portion corresponding to the kind of the predetermined ink.

12. The ink cartridge according to claim 9, wherein:

the plurality of ink identification marks is put on a surface of the cartridge body, and the display portion further includes a cover member attached to the cartridge body so as to cover all of the ink identification marks except the one ink identification mark selected from the plurality of ink identification marks.

13. The ink cartridge according to claim 12, wherein:

the plurality of ink identification marks are arranged circumferentially and disposed in a circle, the cover member includes a shaft portion formed to project on a back surface of the cover member and to be rotatably mounted in a mounting hole formed in a central portion of the circle formed by the plurality of ink identification marks in the cartridge body, and a window portion formed in an outer portion of the cover member so that the one ink identification mark selected from the plurality of ink identification marks can be observed from outside when the cover member has been attached to the cartridge body, and the cover member is rotated around the shaft portion so that the window portion can be aligned with a position of the one ink identification mark of the ink identification marks corresponding to the predetermined ink to be injected.

14. The ink cartridge according to claim 13, wherein:

a plurality of positioning grooves for positioning the cover member in a rotating direction thereof are formed in the cartridge body, a plurality of projecting engagement portions are formed to project on the back surface of the cover member so that the plurality of projecting engagement portions can engage with the plurality of positioning grooves respectively, and projecting length of the shaft portion on the back surface of the cover member is larger than that of each of the plurality of projecting engagement portions likewise.

15. The ink cartridge according to claim 9, wherein the to-be-fitted portion is a protrusion portion provided in a predetermined position of the cover member.

16. An ink cartridge comprising:

a cartridge body containing a predetermined ink, the predetermined ink being one of a plurality of kinds of inks;

a display portion for displaying the kind of the predetermined ink; and a to-be-detected portion to be detected, the to-be-detected portion being a different portion from the display portion and being provided in a position corresponding to the predetermined ink displayed by the display portion, the position being one of a plurality of different positions corresponding to the plurality of kinds of inks, wherein the display portion includes a plurality of ink identification marks corresponding to the plurality of kinds of inks respectively, and one ink identification mark of the plurality of ink identification marks is selected to be displayed, and wherein the position of the to-be-detected portion is selected from the plurality of different positions in accordance with the selection of the one ink identification mark from the plurality of ink identification marks in the display portion.

17. An ink cartridge comprising:

a cartridge body containing a predetermined ink, the predetermined ink being one of a plurality of kinds of inks;

a display portion for displaying the kind of the predetermined ink; and a to-be-fitted portion being a different portion from the display portion and being provided in a position corresponding to the predetermined ink displayed by the display portion, the position being one of a plurality of different positions corresponding to the plurality of kinds of inks, wherein the display portion includes a plurality of ink identification marks corresponding to the plurality of kinds of inks respectively, and one ink identification mark of the plurality of ink identification marks is selected to be displayed, and wherein the position of the to-be-fitted portion is selected from the plurality of different positions in accordance with the selection of the one ink identification mark from the plurality of ink identification marks in the display portion.

* * * * *